US007597452B2

(12) United States Patent
Jeng et al.

(10) Patent No.: US 7,597,452 B2
(45) Date of Patent: Oct. 6, 2009

(54) DIMMABLE LAMP SET WITH REMOTELY GROUP SETTING FUNCTION

(75) Inventors: Po-Wen Jeng, Taipei (TW); Chung-Ming Huang, Taichung (TW); Yuan-Sheng Liang, Taichung (TW); Liang-Chia Tseng, Taichung (TW)

(73) Assignee: Avertronics Inc., Taichung (TW)

( * ) Notice: Subject to any disclaimer, the term of this patent is extended or adjusted under 35 U.S.C. 154(b) by 172 days.

(21) Appl. No.: 11/841,001

(22) Filed: Aug. 20, 2007

(65) Prior Publication Data

US 2009/0052170 A1 Feb. 26, 2009

(51) Int. Cl.
*F21V 33/00* (2006.01)

(52) U.S. Cl. ..... 362/234; 362/231; 362/249.05; 362/249.13; 362/157; 362/233; 340/825.69; 340/825.72; 340/815.4; 340/815.45

(58) Field of Classification Search ..... 362/233, 362/231, 249.05, 249.13, 157, 394, 234; 340/825.69, 825.72, 815.4, 815.45
See application file for complete search history.

(56) References Cited

U.S. PATENT DOCUMENTS 4,962,687 A * 10/1990 Belliveau et al. ..... 84/464 R
7,355,523 B2 * 4/2008 Sid ..... 340/825.52
2008/0266846 A1 * 10/2008 Cheng et al. ..... 362/183

* cited by examiner

*Primary Examiner*—Stephen F Husar
*Assistant Examiner*—James W Cranson

(57) ABSTRACT

A lamp set with remotely group setting function comprising a plurality of lamp assemblies and a remote controller; each lamp assembly including a casing, a signal receiver; a lamp body, a base, a circuit assembly, a power device and a group switch set; the casing for receiving element of the lamp assembly; the function group switches having a plurality of buttons for selecting the package signals sent from the remote controller; the circuit assembly of the lamp assembly being electrically connected to the lamp body, the power device, the receiver, and the group switch set. The circuit assembly serving to read package signals received from the receiver; the group switch set determining whether it is necessary to process the received package signals; if necessary, the circuit assembly will send driving signals to the lamp body to has to present different light effects according to the signals.

11 Claims, 5 Drawing Sheets

DIMMABLE LAMP SET WITH REMOTELY GROUP SETTING FUNCTION

FIELD OF THE INVENTION

The present invention relates to lamps, and particularly to a lamp set with remotely group setting function, other then the lamps, the functions of remote control and light statue setting are also provided. The flash, illumination, hue, color adjustment, and pause of the lamps are adjustable. The dedicated remote controller is used for setting and actuation. The lamp assembly of the present invention has the function of the remotely group setting so as to identify the package signals to the seat. Thus the seat can generate different light effect, and thus the stage may have various light effects. Especially, in the present invention, the remoter controller can store light effects and then trigger the light effect signals to the lamp set for flashing according to the signals.

BACKGROUND OF THE INVENTION

Lamps are necessary electronic devices in currently life. With the advance of technology, necessary lamps are developed, such as LED lamps. Furthermore more light statues are necessary in many fields, for example, to be used in motel, traffic control, landmark indicators, etc. for providing various light effect and alert to users.

In one prior art, Taiwan Patent, No. 087219283, "light effect of stage". In that, a lamp has a control unit, a casing with a regular cross section. A lateral side thereof has a wedge and a front panel thereof has a switch for turning on and off a power source. A back plate thereof is installed with a plurality of receptacles, at least one connecting tenons which are pins, two sides thereof have respective embedding tenons corresponding to the cross section of the grooves. The size and shape are corresponding to the casing of the control unit. The front panel has a bulb. The back plate is connected with an electric wire. One end of the wire is a plug. The embedded tenon can be selectively inserted to the groove of the control unit. The embedding tenon at another side is engaged to a buckling groove of a light unit so that each light unit can be secured to the control unit. The plug of each light unit is engaged to the receptacle of the control unit so that they are electrically connected. Thus, when the switch is pressed, the lamp will have different light effect, such as flash.

However, the above mentioned prior art design has no remote controller and no memory for recording different light status. Thus, the operation is inconvenient and the light effect is dull.

Thereby there is an eager demand for a novel one which can improve the prior art defects to have the operation of remote control and have memories for recording signals about the light status.

SUMMARY OF THE INVENTION

Accordingly, the primary object of the present invention is to provide a lamp set with remotely group setting function, other then the lamps, the functions of remote control and light statue setting are also provided. The flash, illumination, hue, color adjustment, and pause of the lamps are adjustable. The dedicated remote controller is used for setting and actuation. The lamp assembly of the present invention has the function of the remotely group setting so as to identify the package signals to the seat. Thus the seat can generate different light effect. Thus the stage may have various light effects. Especially, in the present invention, the remoter controller can store light effects and then trigger the light effect signals to the lamp set for flashing according to the signals.

To achieve above objects, the present invention provides a lamp set with remotely group setting function comprising a plurality of lamp assemblies and a remote controller; each lamp assembly including a casing, a signal receiver; a lamp body, a base, a circuit assembly, a power device and a group switch set; the casing for receiving element of the lamp assembly; the function group switches having a plurality of buttons for selecting the package signals sent from the remote controller; the circuit assembly of the lamp assembly being electrically connected to the lamp body, the power device, the receiver, and the group switch set. the circuit assembly serving to read package signals received from the receiver; the group switch set determining whether it is necessary to process the received package signals; if necessary, the circuit assembly will send driving signals to the lamp body to has to present different light effects according to the signals.

The various objects and advantages of the present invention will be more readily understood from the following detailed description when read in conjunction with the appended drawing.

DETAILED DESCRIPTION OF THE INVENTION

Figure 1:
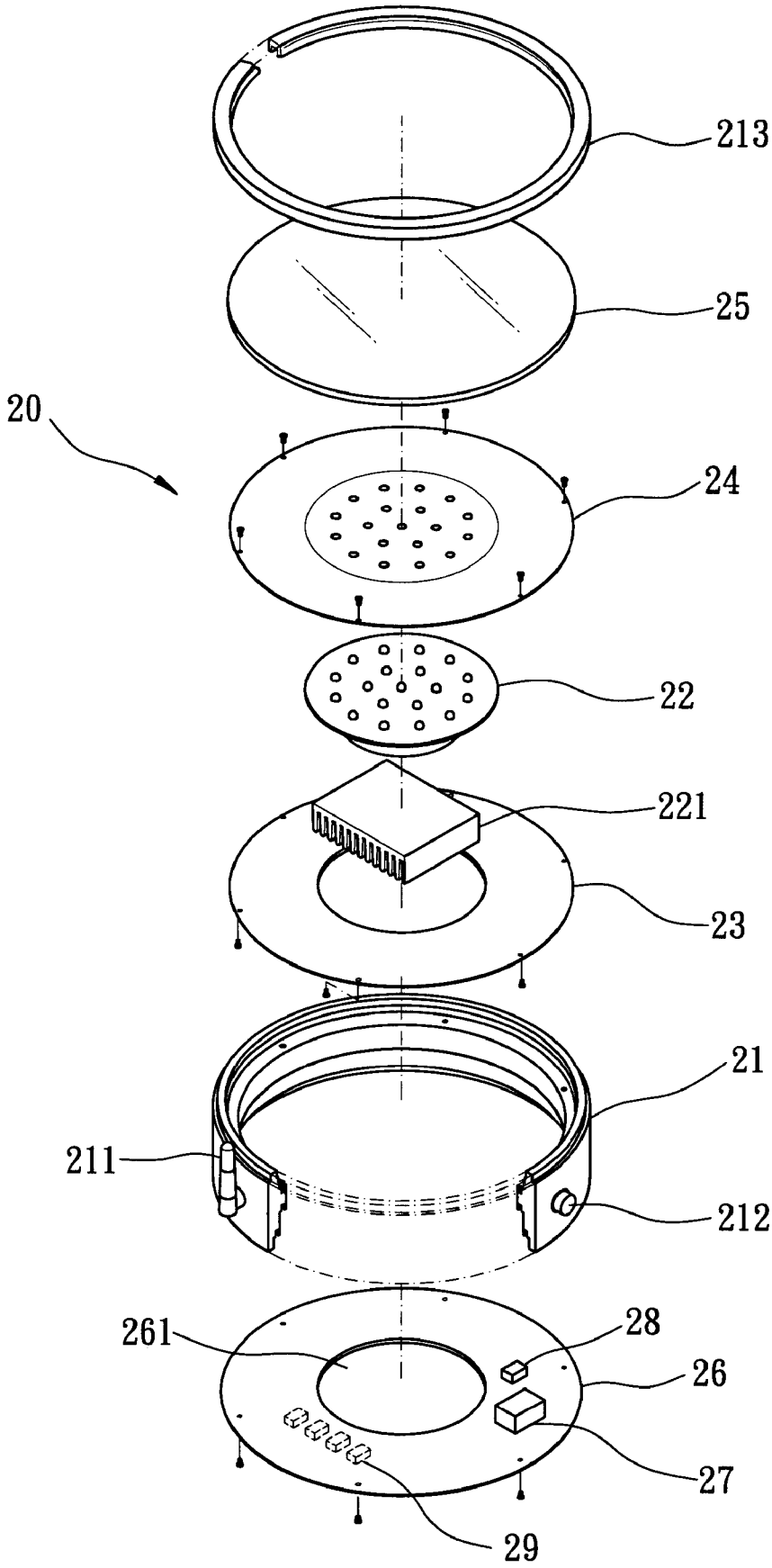
FIG. 1 is an exploded schematic view of the lamp set with remotely group setting function of the present invention.
Figure 2:
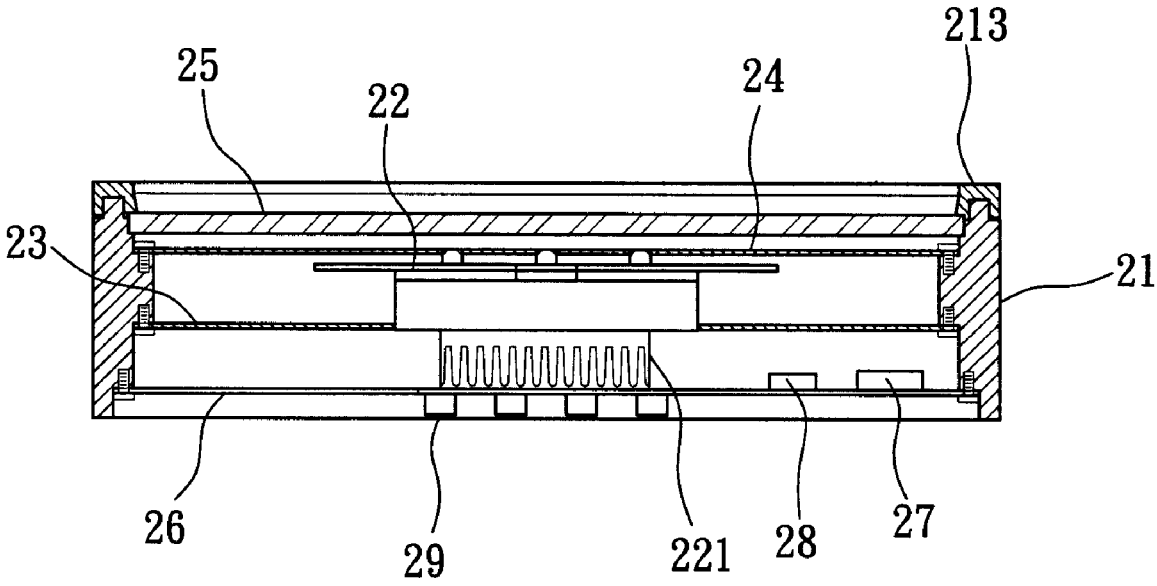
FIG. 2 is a schematic view about the lamp set with remotely group setting function of the present invention.
Figure 3:
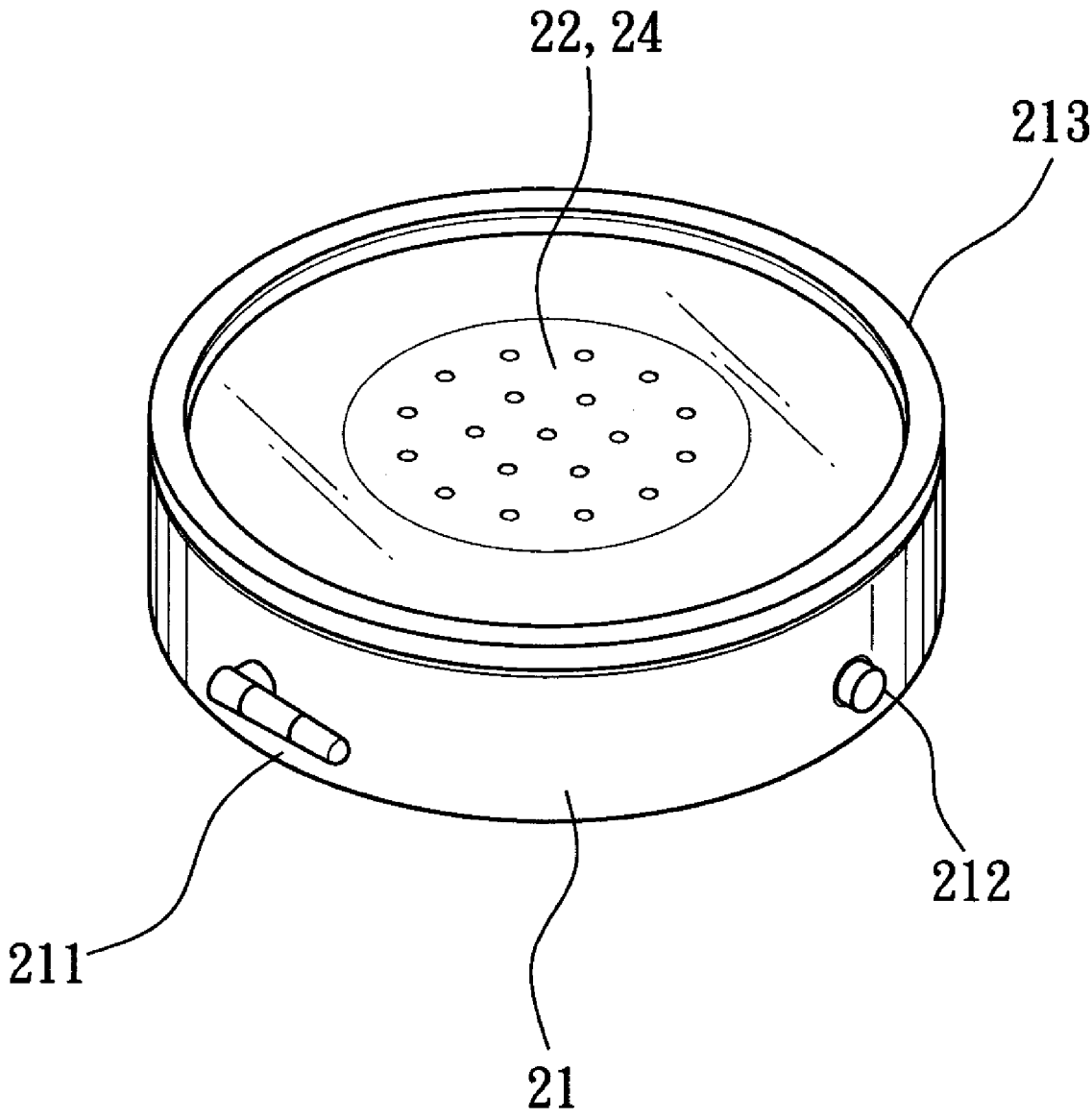
FIG. 3 is a schematic cross sectional view about the lamp set with remotely group setting function of the present invention.
Figure 4:
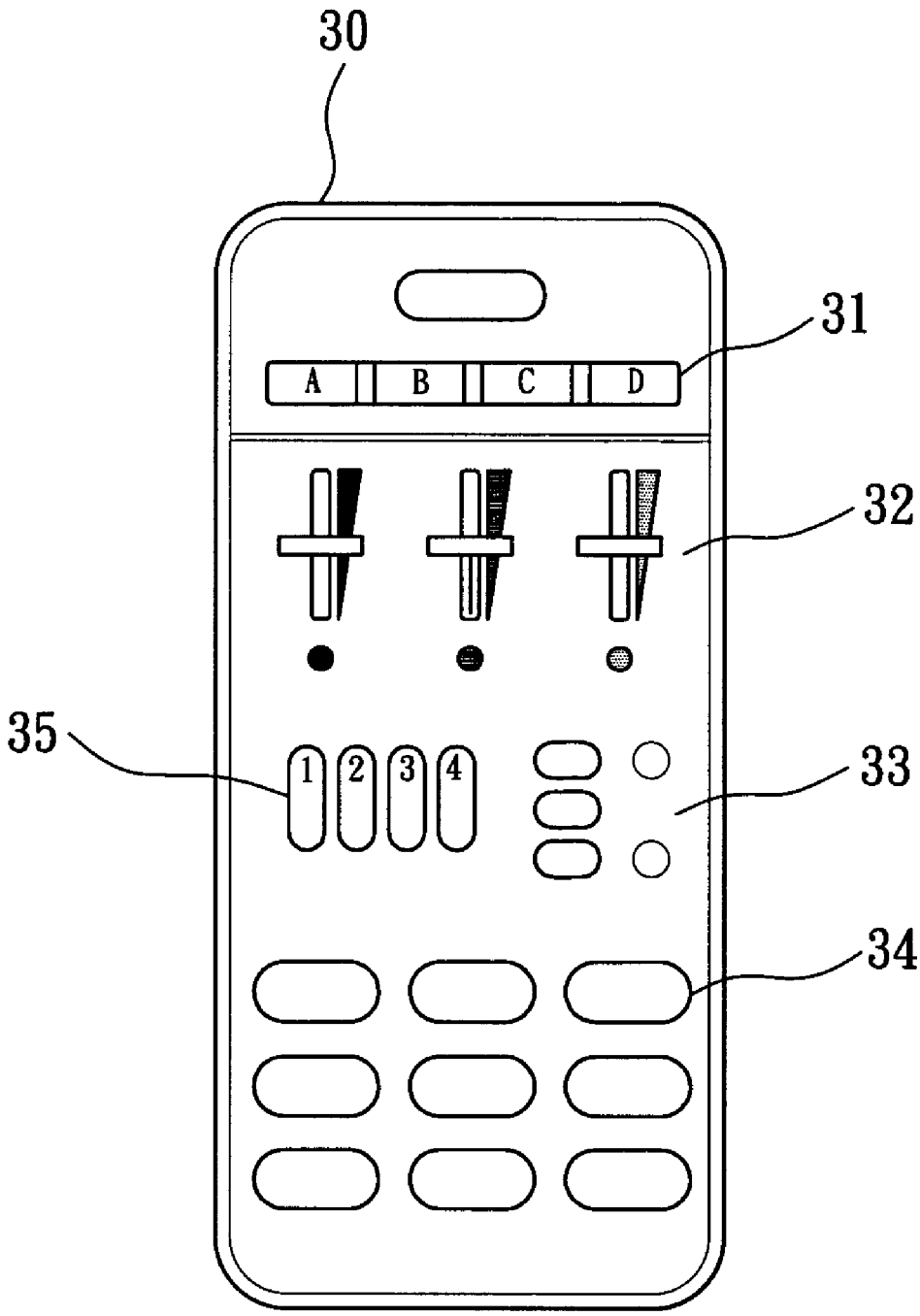
FIG. 4 is a plane schematic view about the lamp set with remotely group setting function of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the function group setting lamp of the present invention is illustrated. The present invention includes a lamp assembly 20 and a remote controller 30.

The lamp assembly 20 includes a casing 21, a lamp body 22, a spacer 23, a lampshade 24, a transparent unit 25, a base 26, a circuit assembly 27, a power device 28 and a group switch set 29.

The casing 21 receives a signal receiver 211 and has a D C current output hole 212. The receiver 211 is an RF receiver (radio frequency receiver) for receiving packaging signals from a remote controller 30. The casing 21 serves for receiving the lamp body 22, the spacer 23, the lampshade 24 and a transparent unit 25. A bottom of the lamp body 22 is adhered with a heat dissipating body 221 for dissipating heat. The spacer 23 is installed at a lower side of the lamp body 22 and the lampshade 24 is installed at an upper side of the lamp body 22 for fixing the lamp body 22. The lamp body 22 is a light emitting diode lamp. A transparent unit 25 is installed at an upper side of the lampshade 24 for protecting the lamp body 22. An upper side of the casing 21 of the lamp assembly 20 is installed with a buckling ring 213 for retaining the element of the casing 21.

The base 26 of the lamp assembly 20 is a round sheet with a hollow center portion. The base 26 is installed at a bottom of the lamp assembly 20. The hollow portion of the base 26 is as a heat dissipating hole so that the heat from the lamp body 22 can be dissipated from the heat dissipating body 221. The function group switch 29 has a plurality of buttons for selecting the package signals sent from the remote controller 30.

The circuit assembly 27 of the lamp assembly 20 is electrically connected to the lamp body 22, power device 28, receiver 211, D C current output hole 212 and group switch set 29. The circuit assembly 27 serves to read the package signals received from the receiver 211. The group switch set 29 determines whether it is necessary to process the received package signals. If necessary, the circuit assembly 27 will send driving signals to the lamp body 22 so as to present different light effects according to the signals. The lamp assembly 20 is also connected to the D C current output hole 212. The power device 28 may be a battery unit for providing power to the lamp assembly 20.

The remote controller 30 has a group control key set 31, a three color ratio control key set 32, a special effect control key 33, a memory control key 35, and an illuminating control key 35. The group control key set 31 provides a group identifier at an initial end of a package signal so as to set the lamp assembly 20 at the same group corresponding to the group switch set 29 so that the circuit assembly 27 of the lamp assembly 20 can assert the package signals. The three color ratio control key set 32 is an adjust slide rod set of red color, green color, and blue color for setting color information of light to the package signals. The special effect control key 33 serves to set the flash, pause, circulation, etc. of light. By above mentioned keys, different light status can be set in the package signals. Finally, the memory control key 35 records the data about the package signals.

Figure 5:
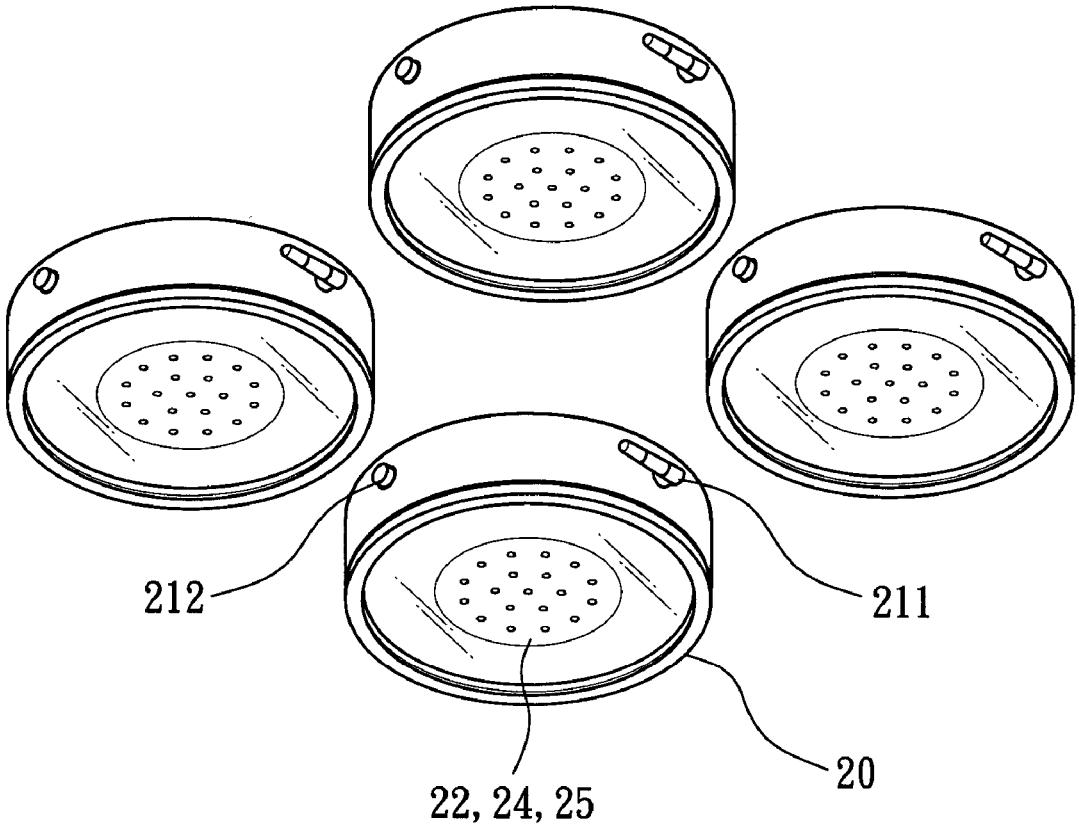
FIG. 5 is a schematic view showing the application of the lamp set with remotely group setting function of the present invention.
Figure 5:
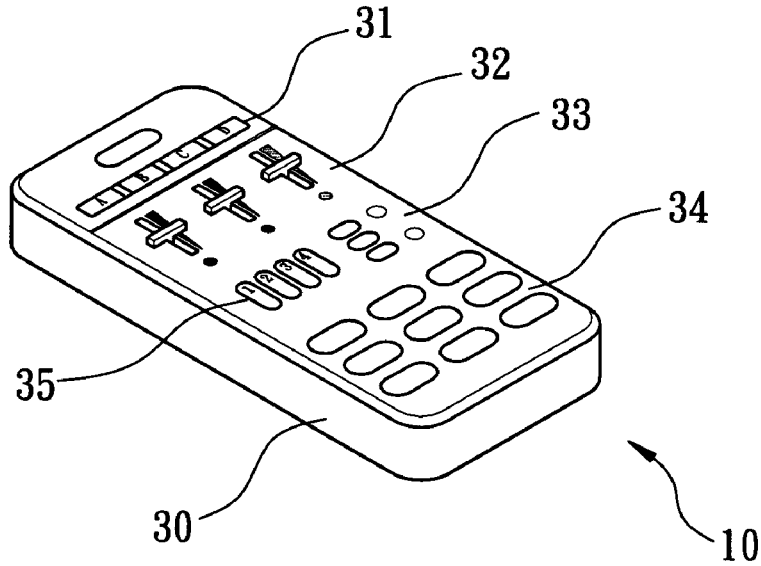

Referring to FIG. 5, in setting the light, the group control key set 31, three color ratio control key set 32, and special effect control key 33 causes that the remote controller 30 generates package signals for different lighting status. Then the memory control key 35 records the package signals. If it is desired to emit the package signals with lighting status, the memory control key 34 will select a desired package signals which is then sent to the receiver 211 in the lamp assembly 20. Then the group control key set 31 will add group identifier to the initial end of the package signals. Thus, when the package signals are transferred to the circuit assembly 27, the circuit assembly 27 will determine whether it is necessary to process the package signals according to the setting of the group switch set 29. If it is necessary to process the package signals, the package signals are decoded and judged and then the decoded data is sent to the lamp body 22. The lamp body 22 will generate desired light status according to data.

The package signals are switched between the group control key set 31 of the remote controller 30 and the group switch set 29 of the lamp assembly 20 so that the remote controller 30 can be set and control a plurality of lamp assemblies 20.

To be emphasized, in the present invention, the remoter controller can store light effects and then trigger the light effect signals to the lamp set for flashing according to the signals.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lamp set with remotely group setting function comprising a plurality of lamp assemblies and a remote controller, the remote controller being capable of storing light effects which can be sent out as a form of package signals;

each lamp assembly including a casing, a signal receiver; a lamp body, a base, a circuit assembly, a power device and a group switch set;

the casing for receiving element of the lamp assembly;

the group switch set having a plurality of buttons for selecting the package signals sent from the remote controller;

the circuit assembly of the lamp assembly being electrically connected to the lamp body, the power device, the receiver, and the group switch set; the circuit assembly serving to read package signals received from the receiver; the group switch set determining whether it is necessary to process the received package signals; if necessary, the circuit assembly will send driving signals to the lamp body to present different light effects according to the signals.

2. The lamp set with remotely group setting function as claimed in claim 1, wherein the remote controller has a memory control key for recording the data about the package signals.

3. The lamp set with remotely group setting function as claimed in claim 1, wherein the remote controller has a group control key set providing a group identifier at an initial end of a package signal so as to set the lamp assembly at the same group corresponding to the group switch set.

4. The lamp set with remotely group setting function as claimed in claim 1, wherein the remote controller has a three color ratio control key set, a special effect control key, and an illuminating control key for setting light status as package signals which is then transferred to the lamp assembly.

5. The lamp set with remotely group setting function as claimed in claim 1, wherein the receiver is an RF receiver for receiving packaging signals from a remote controller.

6. The lamp set with remotely group setting function as claimed in claim 1, wherein a bottom of the lamp body is adhered with a heat dissipating body for dissipating heat.

7. The lamp set with remotely group setting function as claimed in claim 1, wherein the base of the lamp assembly has a base for installing the power device, the circuit assembly and the group switching set; and the hollow portion of the base is as a heat dissipating hole so that the heat from the lamp body can be dissipated from the heat dissipating body.

8. The lamp set with remotely group setting function as claimed in claim 1, wherein the casing has a D C current output hole, the casing is electrically connected to a circuit assembly and a power device.

9. The lamp set with remotely group setting function as claimed in claim 1, wherein the power device is a battery unit for providing power to the lamp assembly.

10. The lamp set with remotely group setting function as claimed in claim 1, wherein the lamp body is a light emitting diode lamp.

11. The lamp set with remotely group setting function as claimed in claim 1, wherein the three color ratio control key set is an adjust slide rod set of red color, green color, and blue color for setting color information of light to the package signals.

* * * * *